US005765263A

United States Patent [19]

Bolinas et al.

[11] Patent Number: 5,765,263

[45] Date of Patent: Jun. 16, 1998

[54] DOOR POSITIONING HINGE

[75] Inventors: Andres A. Bolinas, Claymont, Del.; Thomas Edwin Hall, Oxford, Pa.; Lynn Ann Handley, West Chester, Pa.; Stefan Matthew Koveal, Glen Mills, Pa.; Allen Riblett, Ardentown, Del.

[73] Assignee: Southco, Inc., Concordville, Pa.

[21] Appl. No.: 680,178

[22] Filed: Jul. 15, 1996

[51] Int. Cl.[6] ..... E05D 11/10

[52] U.S. Cl. ..... 16/342; 16/139; 16/250

[58] Field of Search ..... 16/342, 321, 334, 16/344, 322, 335, 380, 381, 386, 250, 251

[56] References Cited

U.S. PATENT DOCUMENTS

| | | | |
|---|---|---|---|
| D. 269,943 | 8/1983 | Bisbing . | |
| D. 278,309 | 4/1985 | Vickers . | |
| D. 284,931 | 8/1986 | Bisbing . | |
| D. 303,491 | 9/1989 | Bisbing . | |
| D. 303,492 | 9/1989 | Bisbing . | |
| 324,444 | 8/1885 | Wolf . | |
| 2,591,476 | 4/1952 | Swanson . | |
| 3,000,049 | 9/1961 | Terry | 16/139 |
| 3,874,029 | 4/1975 | McCullough . | |
| 4,073,037 | 2/1978 | Curry et al. | 16/381 |
| 4,439,888 | 4/1984 | Merillat . | |
| 4,490,884 | 1/1985 | Vickers . | |
| 4,501,045 | 2/1985 | Boyer . | |
| 4,570,291 | 2/1986 | Smith et al. | 16/250 |
| 4,630,333 | 12/1986 | Vickers . | |
| 4,847,950 | 7/1989 | Coleman | 16/381 |
| 4,897,873 | 1/1990 | Beutler . | |
| 4,987,640 | 1/1991 | Lin . | |
| 5,020,189 | 6/1991 | Grome . | |
| 5,040,268 | 8/1991 | Knurr . | |
| 5,409,297 | 4/1995 | De Feilippo | 16/334 |
| 5,412,842 | 5/1995 | Riblett . | |
| 5,485,655 | 1/1996 | Wang | 16/321 |

FOREIGN PATENT DOCUMENTS

| | | |
|---|---|---|
| 0647756 | 9/1994 | European Pat. Off. . |
| 1321501 | 2/1963 | France . |
| 816066 | 10/1951 | Germany . |
| 376389 | 3/1964 | Switzerland . |
| 404854 | 1/1934 | United Kingdom . |
| 2052618 | 1/1981 | United Kingdom . |
| 2125497 | 3/1984 | United Kingdom . |
| 2193528 | 2/1988 | United Kingdom . |
| 2097465 | 4/1992 | United Kingdom . |
| 1391215 | 4/1995 | United Kingdom . |
| WO/00272 | 1/1988 | WIPO . |

OTHER PUBLICATIONS

*Southco Latches and Access Hardware Handbook 45 NA*, Section M, pages M–1 through M–14 published by Southco, Inc. 1995.

Five (5) Photographs labeled "A–E" of a food tray believed to be of a type used in a passenger train in Europe.

Copy of photograph "B".

*Primary Examiner*—A. L. Pitts
*Assistant Examiner*—Mark Williams
*Attorney, Agent, or Firm*—Paul & Paul

[57] ABSTRACT

A door positioning hinge supports two closure members, and also allows the closure members to be rotated to open or to close. The door positioning hinge can be adapted to allow free-swinging of the closure members or alternatively to hold the closure members in various detent positions. In addition, the particular amount of force can be selected where desired which operates to hold the closure members in the respective detent positions. The operation of the door positioning hinge accommodates use with both vertically swinging or horizontally swinging closure members.

49 Claims, 9 Drawing Sheets

DOOR POSITIONING HINGE

BACKGROUND OF THE INVENTION

1. Field of the Invention

The present invention relates generally to hinge devices for supporting doors, lids, covers and the like and more particularly to hinge devices which can retain a door, lid, cover and the like in an opened or closed position relative to a frame.

2. Brief Description of the Prior Art

Various types of hinge devices which function to retain a door, lid, cover and the like in an opened or closed position are known. Some types used on vertically swinging kitchen cabinet doors exert a torque in order to retain the door in a closed position. However, the amount of torque provided from the hinge is not sufficient in some circumstances to retain the door in the closed position; for example, in response to inadvertent contact forces. In addition, these types of hinges do not function to retain the door in an open position. Another type of hinge used on vertically swinging doors incorporates a wave shaped cam surface which allows the door to rest in either an opened or closed position. However, the opened or closed positioning of the hinge is limited to the location of the downward sloped portion of the cam surface. In addition, the application of the hinge is limited to vertically swinging doors since the weight of the door on the cam surface functions to position the hinge. Still another type of hinge in common use incorporates an adjustable knuckle member which generates a torque upon a hinge pin in order to retain a vertically or horizontally swinging door in an opened position. However, the torque which is generated by adjustment of a screw member creates drag throughout the entire range of motion of the hinge. In addition, the hinge has a tendency to spring open slightly when the door is closed, thus requiring an additional latch to retain the door in the closed position.

Another type of hinge is shown in U.S. Pat. No. 5,412,842 to Allen Riblett and assigned to the assignee of the present invention, and is incorporated by reference herein. U.S. Pat. No. 5,412,842 is directed to a detent hinge for use with either vertically or horizontally swinging doors. The detent hinge incorporates detent balls and coil springs which operate to bias the detent balls in the direction of a pin assembly. The pin assembly is provided with a number of openings provided within its surface into which the detent balls are adapted to be received for retaining the door in a detent position relative to the frame. The detent hinge also incorporates means for adjusting the amount of torque which is required to move the hinge out of its detent positions, which is accomplished by varying the size, strength and/or number of coil springs and detent balls within the hinge. For this purpose, the detent hinge is provided with a removable retaining member which is opened to gain access for adjusting the amount of torque provided by the coil springs and detent balls. There have, however, been certain limitations noted with this particular detent hinge. One limitation is that the hinge must be of a sufficiently large enough size due to the arrangement of the coil springs and detent balls within the device. Accordingly, there is a limit in the types of applications that this particular detent hinge can be used; specifically, such hinge can not be used in certain applications where a smaller hinge would be required, such as with smaller doors or where space for mounting the hinge would be limited. Another limitation is that the detent hinge can be suspectable to corrosion due to the particular materials of the device; in particular, due to the coil springs and detent balls which are preferably manufacturered of metal. For this same reason, the relative costs to manufacture the device can be higher since components manufacturered of metal are utilized.

There is a need for a door positioning hinge which is versatile in application, can be manufacturered in smaller sizes and of cheaper materials, and which would not be susceptible to corrosion.

SUMMARY OF THE INVENTION

The present invention provides a door positioning hinge. The door positioning hinge comprises a hinge assembly including a first hinge means and a second hinge means, and each of the hinge means have at least one bore. A pin assembly is provided disposed within the bores of the first and second hinge means in order to connect the hinge assembly so that the first hinge means will be rotatable relative to the second hinge means.

In accordance with the present invention, an object is to provide a novel door positioning hinge.

Another object of the present invention is to provide a versatile door positioning hinge which can be adapted for use in a number of different applications. For example, adapted to be used to support a closure member, such as a door, cover or lid, and also operate as a "free-swinging" hinge, which allows the closure member to rotate freely, or as a "detent" hinge, which is adapted to hold the closure member in any desired position as the door is opened or closed.

It is another object of the present invention to provide a door positioning hinge operable as a "detent" hinge and capable of being adjusted in order to vary the amount of force provided by the hinge which holds the closure member in a given position.

Another object of the present invention is to provide a door positioning hinge which, when operating as a "detent" hinge, is resistant to corrosion occurring in the device.

Still another object of the present invention is to provide a door positioning hinge in which the parts are few and which can be manufacturered from inexpensive materials.

Another object of the present invention is to provide a door positioning hinge which provides for easier assembly and disassembly.

These and other objects of the present invention will become more readily apparent when taken into consideration with the following description and the attached drawings.

DETAILED DESCRIPTION OF THE PREFERRED EMBODIMENTS

Figure 1:
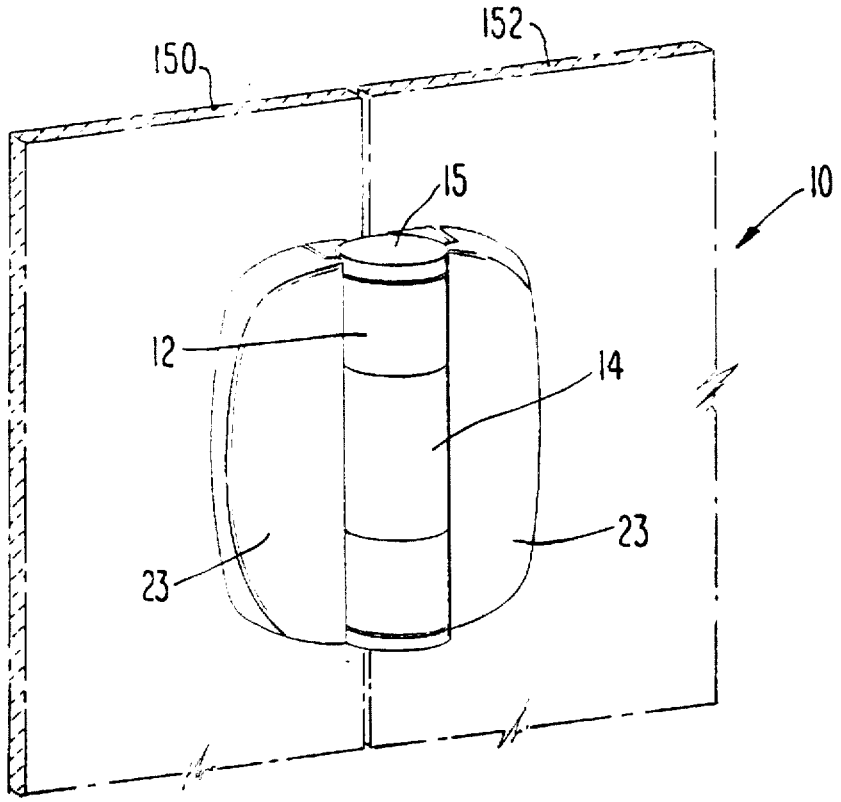
FIG. 1 is a perspective view illustrating a door positioning hinge according to an embodiment of the present invention.
Figure 2B:
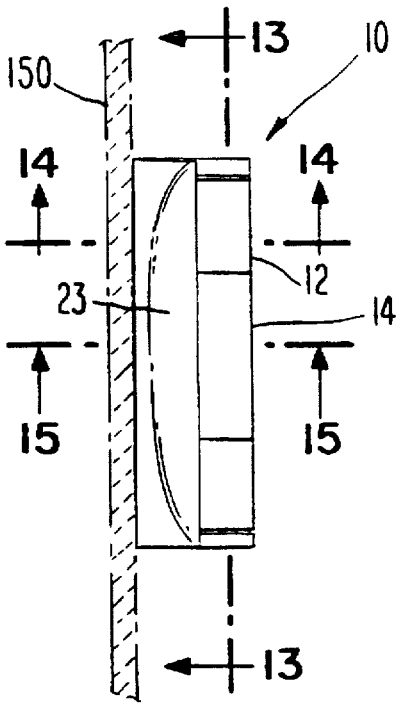
FIG. 2*b* is a left side elevational view of the door positioning hinge of FIG. 1.
Figure 2A:
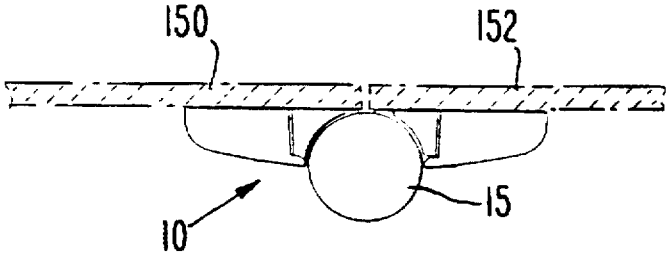
FIG. 2*a* is a top plan view of the door positioning hinge of FIG. 1.
Figure 2C:
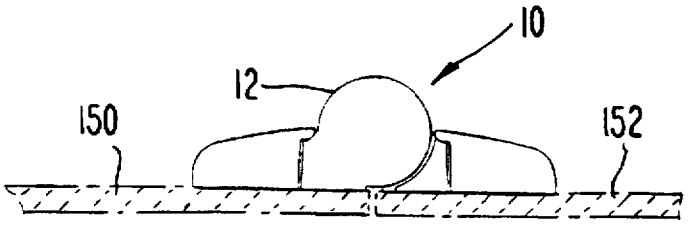
FIG. 2*c* is a bottom plan view of the door positioning hinge of FIG. 1.
Figure 1A:
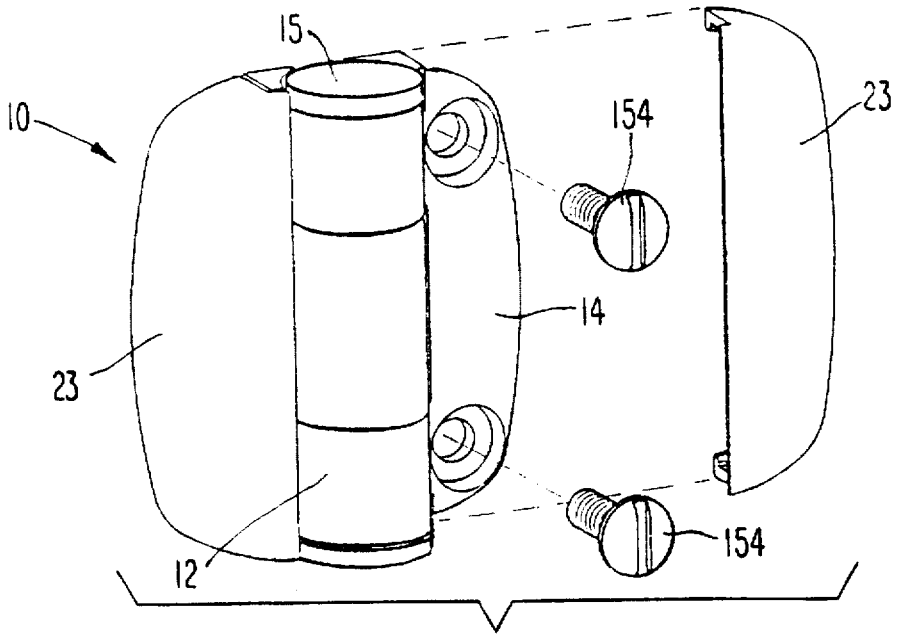
FIG. 1*a* is a partly exploded view of the door positioning hinge of FIG. 1.

Referring now to the drawings in detail, wherein like reference numerals indicate like elements throughout the several views, there is shown in FIGS. 1–16 a door positioning hinge in accordance with an embodiment of the present invention. The door positioning hinge 10 as is shown comprises, as portions thereof, a hinge assembly which includes a first hinge means comprising a first hinge leaf 12 and a second hinge means comprising a second hinge leaf 14, and a pin assembly 15. The door positioning hinge 10 can also comprise a cover preferably comprising two covers 23. The details of each of these elements will be more fully described in the following paragraphs. In the perspective view of FIG. 1 and top plan, side and bottom plan views of FIGS. 2*a–c*, the door positioning hinge 10 is shown secured to closure members 150 and 152 in dotted lines, with the first hinge leaf 12 being secured to the closure member 150 and the second hinge leaf 14 being secured to the closure member 152. In the present embodiment, as is shown in the partly exploded view of FIG. 1*a*, the first hinge leaf 12 and second hinge leaf 14 are secured to the closure members 150 and 152 by four screws 154 (only two of which are visible), with a pair of the screws 154 extending through each of the first and second hinge leaves 12 and 14 in the manner shown and then into the respective closure members 150 and 152, as shown in FIG. 1. It should be understood that, while the screws 154 are illustrated in the present embodiment, other suitable securing mechanisms can also be used, such as rivets, adhesives such as glue or double-sided adhesive tape, to name a few. The closure members 150 and 152 can be closure members of any type, such as those which are adapted to swing on either vertically or horizontally positioned hinges, examples of which are vertically swinging doors that are mounted to a frame such as kitchen cabinet doors, or horizontally swinging covers or lids mounted to a container, such as a storage chest.

Figure 3:
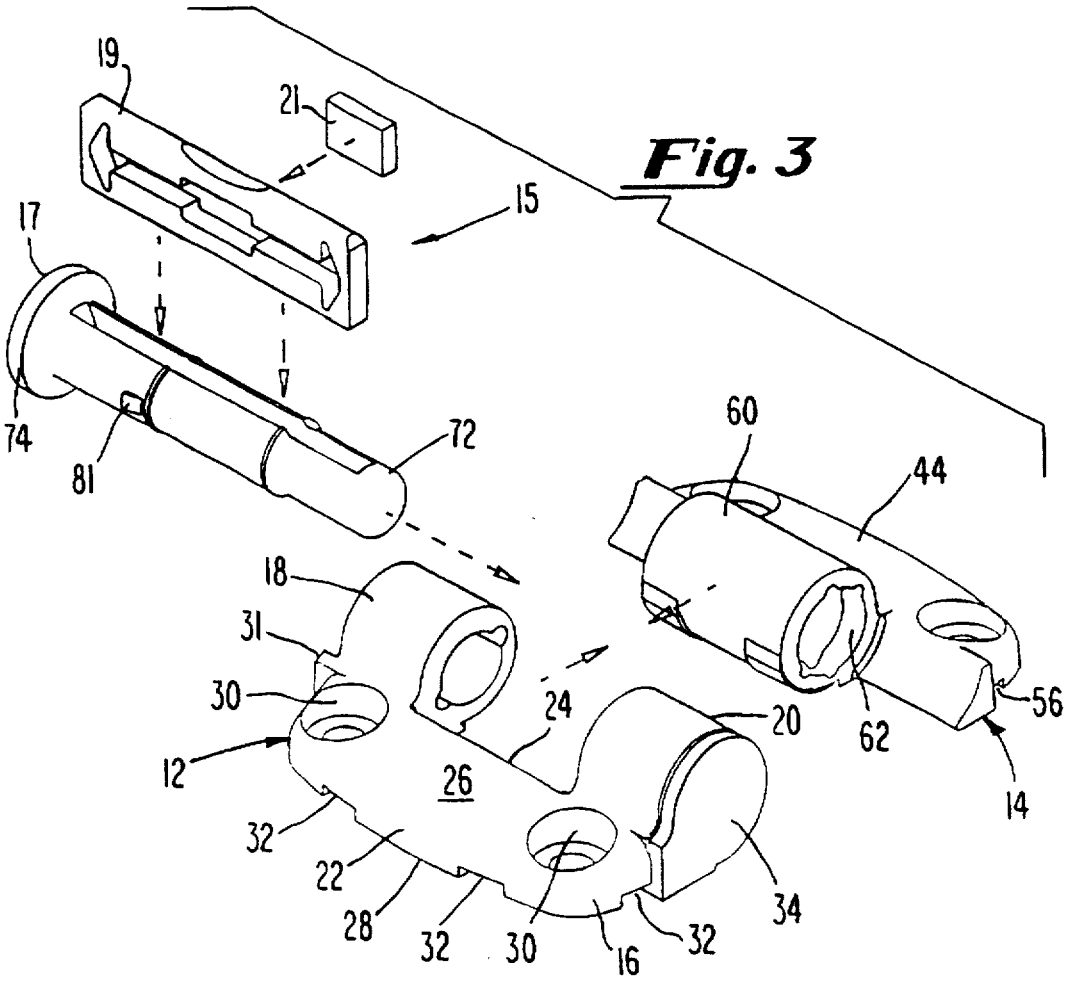
FIG. 3 is an exploded perspective view of the door positioning hinge of FIG. 1 and showing a first hinge leaf, a second hinge leaf, a hinge pin, a hinge pin insert and a spring.
Figure 4:
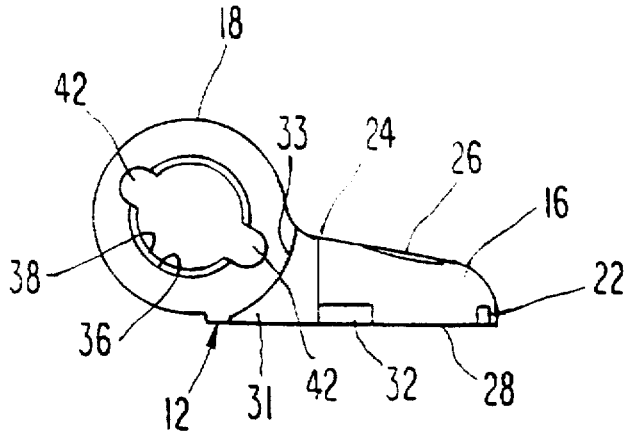
FIG. 4 is a left side elevational view of the first hinge leaf of FIG. 3.

As shown in FIG. 3, the first hinge leaf 12 comprises a base 16 and first and second knuckles 18 and 20, respectively. The base 16 as shown includes a generally U-shaped outer surface 22 opposite the knuckles 18 and 20 and a substantially planar inner surface 24 connected with the outer surface 22 and adjacent the knuckles 18 and 20. As best seen in FIG. 4, the base 16 further includes an upper surface 26 which slopes downward from the first knuckle 18 to the outer surface 22, and a generally planar bottom surface 28 opposite the upper surface 26. Further, in this embodiment, the base 16 further includes two screw receiving apertures 30 extending completely therethrough from the upper surface 26 to the bottom surface 28, as is best seen in FIG. 3. Each of the screw receiving apertures 30 define a substantially cylindrical shaped cavity within the upper surface 26 and which terminates by an annular seating member between the upper surface 26 and bottom surface 28, which defines a second generally cylindrical cavity of a smaller diameter extending through the bottom surface 28. The base 16 also includes at least one and preferably four pockets comprising cavities 32, each generally rectangular in configuration, provided within the bottom surface 28 and extending upward in the direction of the upper surface 26 which terminates within a portion of the outer surface 22. As is shown in FIGS. 3 and 4, two of the cavities 32 are positioned adjacent to one another and on the portion of the outer surface 22 which is generally opposite the inner portion 24. The remaining two cavities 32 are positioned on opposite sides of the outer surface 22 and adjacent each of the knuckles 18 and 20.

As best seen in FIG. 3, the first and second knuckles 18 and 20 are connected with the inner surface 24 of the base 16. Generally, each of the knuckles 18 and 20 have generally cylindrical outer surfaces and a bore extending therein which defines an inner surface. The second knuckle 20 also includes an end wall 34 connected with its outer surface and which terminates adjacent the bore within its inner surface, which is not shown in FIG. 3. As is best shown in the left side elevational view of FIG. 4, the first knuckle 18 includes a bore 36 therein and the second knuckle 20 includes a bore 38 therein. As is shown, each of the bores 36 and 38 are generally cylindrical in configuration and of substantially constant diameter in the longitudinal direction of each knuckle. In the present embodiment, the diameter of the bore extending through the second knuckle 20 defined by the inner surface 38 is slightly smaller than that of the bore extending through the first knuckle 18 defined by the inner surface 36. In addition, provided within the bores of each of the knuckles 18 and 20 within their respective inner surfaces 36 and 38 is at least one groove or cavity 42 which extends the entire longitudinal direction of each knuckle. In the present embodiment, two opposing cavities 42 generally 180° apart are provided within each knuckle 18 and 20. Further, in this embodiment, the radius of each of the cavities 42 are the same when measured from an imaginary central axis extending longitudinally through each of the knuckles 18 and 20 to the outer most portion of the cavity 42. Preferably, the cavities 42 are substantially semi-circular or U-shaped in cross section, however, as should be understood, other suitable configurations of the cavities 42 can also be utilized, such as wedge or V-shaped. In addition, although in the present embodiment two cavities 42 are shown provided within each knuckle and spaced generally 180° apart, it should be understood that any number of cavities 42 and spaced at any desired interval within each knuckle can also be utilized in accordance with the present invention.

The first hinge leaf 12 also includes a terminating end portion 31 adjacent the first knuckle 18. The end portion 31 is formed by a portion of the upper surface 26 and a portion of the bottom surface 28. In particular, a portion of the bottom surface 28 extends outwardly past the position of the upper surface 26, which substantially corresponds to the position of the front surface 24, and the upper surface 26 and bottom surface 28 of the end portion 31 are connected by a substantially concave surface 33.

Figure 5:
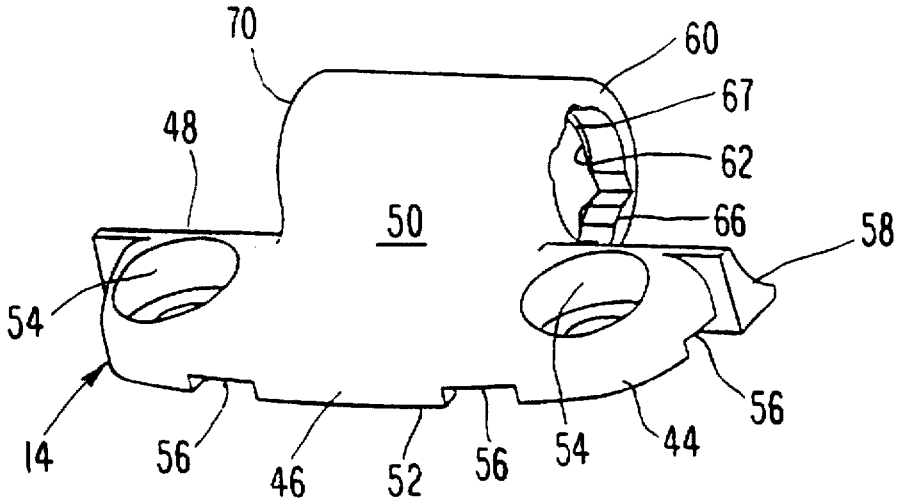
FIG. 5 is an isolated perspective view illustrating the second hinge leaf of FIG. 3.
Figure 6:
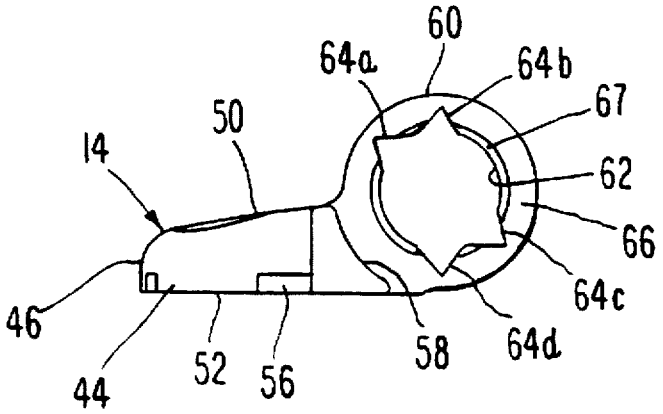
FIG. 6 is a right side elevational view showing the door positioning hinge of FIG. 5.
Figure 7:
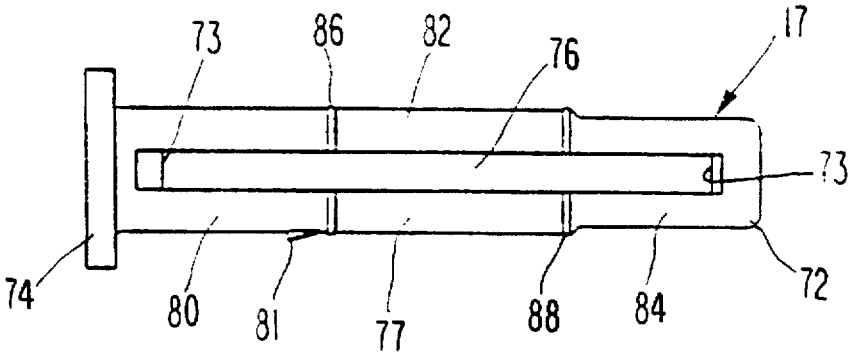
FIG. 7 is an isolated top plan view of the hinge pin of FIG. 3.

The second hinge leaf 14 is best shown in FIG. 3, the perspective view of FIG. 5 and the right side elevational view of FIG. 6. The second hinge leaf 14 includes a base 44 which substantially corresponds to the base 16 of the first hinge leaf 12. In particular, the second hinge leaf 14 includes a substantially U-shaped outer surface 46 connected with a front surface 48. The second hinge leaf 14 also includes a sloped upper surface 50 and a bottom surface 52, with screw receiving apertures 54 extending within each of these surfaces and through the base 44, similar to the upper and bottom surfaces 26 and 28, and screw receiving apertures 30 of the first hinge leaf 12. In addition, the second hinge leaf 14 includes at least one and preferably four pockets comprising cavities 56 within its bottom surface 52 and extending into a portion of its outer surface 46 which correspond to the cavities 32 of the first hinge leaf 12. Specifically, the four cavities are, in this embodiment, generally square in shape and are each provided positioned within the outer surface 46 of the base 44. Further, two of the cavities 56 are on terminating ends of the outer surface 46 adjacent the front surface 48, with the remaining two cavities 56 being positioned on the outer surface 46 opposite the front surface 48 and generally adjacent to each other and between the first two cavities 56. The primary difference of the base 44 is that the front surface 48 is not substantially planar, but rather the bottom surface 52 extends outward past the position of the terminating end of the upper surface 50, with a generally convex surface 58 connecting the upper surfaces 50 and bottom surface 52, which is similar to the concave surface 33 of the first hinge leaf 12.

The second hinge leaf 14 also includes one knuckle comprising a detent knuckle 60 connected with the front surface 48 of the base 44. The detent knuckle 60 is a generally elongated member having a generally cylindrical outer service and a bore therein defining an inner surface 62. As best shown in FIG. 6, the detent knuckle 60 is connected by its outer surface to the generally concave surface 58 of the base 44. The inner surface 62 defines a generally cylindrical bore extending longitudinally completely through the detent knuckle 60. In addition, there is provided within the inner surface 62 at least one groove or cavity which, in this embodiment, extends longitudinally the entire length of the bore. Furthermore, the radius of the cavity is constant over its entire length, which is measured from an imaginary central axis extending longitudinally through the bore. In the present embodiment, four cavities 64*a–d* are provided within the inner surface 62, with the cavities 64*a* and *c* being positioned generally 180° apart and substantially aligned with each other, and the cavities 64*b* and *d* being positioned generally 180° apart and substantially aligned with each other. Furthermore, the cavities 64*a* and *b* are positioned generally adjacent each other and the cavities 64*c* and *d* are similarly positioned generally opposing the cavities 64*a* and *b*. In this embodiment, while the four cavities 64*a–d* are shown, it should be understood that any number of cavities and at any desired location or spacing can be provided for the same purpose, which will be described in detail below. Furthermore, in this embodiment, the configuration of each of the cavities is substantially wedge or V-shaped in configuration, however, it should be understood that other suitable configurations can also be utilized, such as semi-circular or U-shaped in cross-section, as an example. Furthermore, in the present embodiment, a slightly larger bore is provided through a small portion of the detent knuckle 60. Specifically, a larger diameter extends inward from one end 66 and terminates by a substantially annular seat 67. Accordingly, the diameter of the bore defined by the inner surface 62 is slightly larger between an end portion 66 and the seating member 67 than the portion of the bore extending between the seating member 67 and an opposing end 70 of the detent knuckle 60.

In accordance with the present embodiment, the first and second hinge leaves 12 and 14 preferably are comprised of conventional thermoplastic or thermosetting materials, such as nylon. However, other suitable materials can also be used without departing from the scope and spirit of the present invention.

The pin assembly 15 as shown in FIG. 3 in this embodiment comprises a hinge pin 17, a hinge pin insert 19 and a spring 21. The hinge pin 17 is shown in FIG. 3 and the top plan view of FIG. 7. The hinge pin 17 as shown is generally T-shaped in configuration defined by a substantially elongated portion 72, which is generally cylindrical in cross section, and a disk shaped top 74. The disk 74 comprises a substantially circular member connected with one end of the portion 72. The generally elongated portion 72 further includes a slot or cavity 76 extending within its outer surface 77. In this embodiment, the cavity 76 extends entirely through the generally elongated portion 72 and is substantially rectangular in configuration defining a substantially rectangular-shaped inner surface of the hinge pin 17 extending longitudinally from proximate the disk 74 and terminating proximate the free end of the generally elongated portion 72. In addition, in this embodiment, preferably the portions of the inner surface adjacent the disk 74 and free end of the portion 72 are slightly V-shaped inwardly towards each other at 73. The generally elongated portion 72 is divided into three substantially equal sized portions 80, 82 and 84. The portions 80 and 82 are separated by a slightly raised boss 86 and the portions 82 and 84 are separated by slightly raised boss 88. Each of the bosses 86 and 88 extend completely around the hinge pin 17. The portion 80 is included with a substantially triangular shaped boss 81 extending from its outer surface. In this embodiment, the portions 80 and 82 are of substantially constant diameter and the portion 84 is of a diameter less than both of the portions 80 and 82. Generally, the smaller diameter of the portion 84 is provided by an inwardly shaped taper extending from the boss 88. The hinge pin 17 in accordance with the present embodiment can be manufacturered from standard thermoplastic and thermosetting materials, such as acetal, however other suitable materials can also be utilized.

Figure 8:
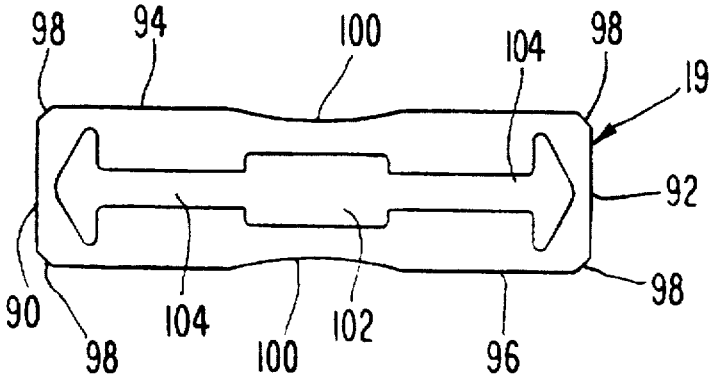
FIG. 8 is an isolated front elevational view illustrating the hinge pin insert of FIG. 3.
Figure 9:
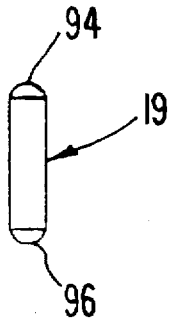
FIG. 9 is a right side elevational view showing the hinge pin insert of FIG. 8, the left side being a mirror image.
Figure 10:
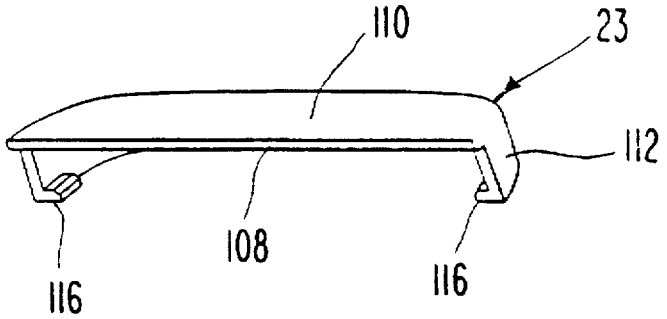
FIG. 10 is an isolated perspective view illustrating a cover of FIG. 1.
Figure 11:
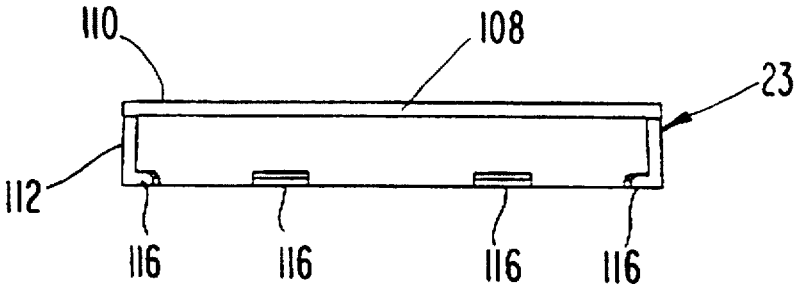
FIG. 11 is a front elevational view of the cover of FIG. 10.
Figure 12:
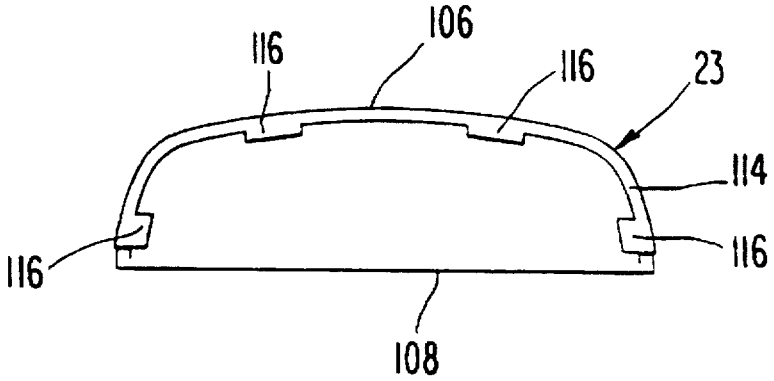
FIG. 12 is a bottom plan view illustrating the cover of FIG. 11.
Figure 13:
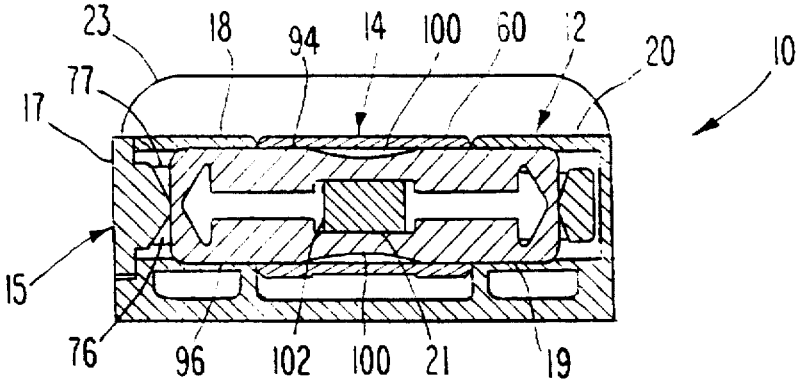
FIG. 13 is a sectional front elevational view taken along the line 13—13 of FIG. 2*b*.

The hinge pin insert 19 is shown in FIG. 3, the front elevational view of FIG. 8 and the side elevational view of FIG. 9. The hinge pin insert 19 is generally rectangular in shape defined by a pair of end surfaces 90 and 92 and outer surfaces 94 and 96. In this embodiment, the hinge pin insert 19 is generally hourglass in shape defined by two opposing concave shaped portions 100 provided within the center of each of the opposing outer surfaces 94 and 96. The concave shaped portions 100 can also be positioned at any other location along the insert 19 or be of other suitable configurations, such as planar or convex, to name a few. Furthermore, in this embodiment a chamfer 98 is provided within each of the four corners of the hinge pin insert 19. In addition, perferrably a window or cavity 102 is provided within the insert and between the opposing concave portions 100. In the present embodiment, the cavity 102 is generally rectangular in shape. In addition, extending from opposite ends of the cavity 102 are two arrow shaped cavities 104 which terminate proximate the end surfaces 90 and 92. As should be understood, other suitable configurations of cavities 102 and 104 can also be utilized. As is shown in the side view of FIG. 9, each of the outer surfaces 94 and 96 are generally radiused in cross-section, although other shapes can also be used, such as straight, planar or wedge shaped. In the present embodiment, the hinge pin insert 19 is preferably manufacturered of conventional thermosetting or thermoplastic materials such as acetal, however, as should be understood, other suitable materials could also be utilized where desired.

The spring 21 is best shown in the exploded prospective view of FIG. 3. In this embodiment, the spring 21 is generally rectangular in shape and is comprised of conventional elastomer or elastomeric material, an example of which is urethane rubber. As it will be understood, the spring 21 can be provided in either larger or smaller sizes, of other shapes, or of other materials; for example, a range from softer or harder elastomers can be utilized.

As indicated earlier, preferably a cover is provided, which in the present embodiment comprises two identical covers 23. One cover 23 is shown in FIG. 1 and FIGS. 10–12. In the present embodiment, the configuration of each cover 23 generally corresponds to that of the base portions 16 and 50 of the first and second hinge leaves 12 and 14 however this is not required. Specifically, the cover 23 includes a substantially U-shaped outer portion 106 and a substantially planar inner portion 108 connected with the U-shaped portion 106. The cover 23 is defined by an upper surface 110 and a substantially U-shaped side portion 112 connected to and extending from the upper surface 110. The U-shaped side portion 112 in turn defines a bottom surface 114 opposite the upper surface 110. Furthermore, at least one, and in the present embodiment, four tabs 116 are provided which extend inward from the bottom surface 114. Generally, the position of the tabs 116 correspond to that of the cavities 32 and 56 provided within the first and second leaves 12 and 14. Specifically, a first pair of tabs 116 are positioned proximate the planar inner portion 108 and generally opposite each other and a second pair of tabs 116 are adjacent to one another and between the first pair of tabs 116. In this embodiment, each of the tabs 116 are generally rectangular in configuration and beveled at their terminating ends opposite the bottom surface 114. The cover 23, in accordance with the present embodiment, can be manufacturered from conventional thermoplastic or thermosetting materials, an example of which is nylon.

The assembly of the door positioning hinge 10 of the present invention will now be described. The spring 21 is positioned within the cavity 102 of the hinge insert 19, and the hinge pin insert 19 is mounted within the slot 76 within the hinge pin 17, such as is shown in the sectional view of FIG. 13. In the present embodiment, each of the two outer surfaces 94 and 96 of the insert 19 define a boss and the concave surfaces 100 define bearing members on a section of the opposing bosses, the operation of each will be more fully described hereinafter. Preferably, at least the bearing members defined by the concave surfaces 100 in the present embodiment terminate at a distance further from the central axis of the hinge pin 17 than does the outer pin surface 77 relative to the central axis of the hinge pin 17. Specifically, this is accomplished in the present embodiment by having at least the diameter of the insert 19 between the bearing members 100 to be larger than that of the hinge pin 17, at least proximate the cavity 76 extending therethrough. Preferably, in the present embodiment, the diameter between the outer surfaces 94 and 96 along the entire length of the insert 19 is greater than that of the hinge pin 17; in particular, which is attributed to the hourglass configuration of the insert 19.

Figure 14:
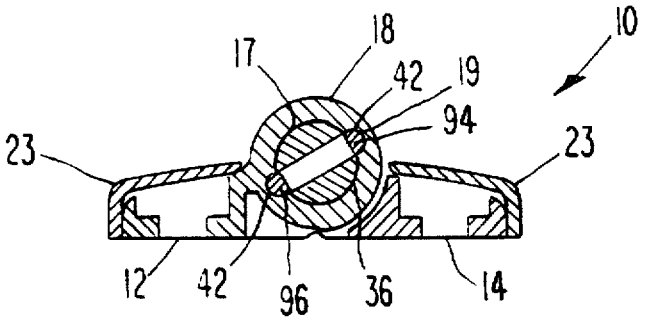
FIG. 14 is a sectional right side elevational view taken along the line 14—14 of FIG. 2*b*.

The assembly of the first and second hinge leaves 12 and 14 is accomplished by inserting the detent knuckle 60 between the first and second knuckles 18 and 20 so that each of the bores within the respective knuckles are aligned with one another. At this point, the pin assembly 15 is then inserted into the bores of the hinge leaves 12 and 14 for connection of the hinge assembly. In accordance with one feature of the present invention, means are provided between the pin assembly 15 and the first hinge leaf 12 for retaining the pin assembly 15. Specifically, in the present embodiment, this is accomplished by the relationship between the bosses 94 and 96 of the insert 19 and the cavities 42 provided within the respective inner surfaces 36 and 38 of the first and second knuckles 18 and 20. In particular, the pin assembly 15 is mounted so that the bosses 94 and 96 are received within the cavities 42 of each knuckle 18 and 20 which operates to retain the position of the pin assembly 15 relative to the first hinge leaf 12. In FIG. 14 is illustrated the foregoing position of the insert 19 relative to the first knuckle 18. Furthermore, although not shown in FIG. 14, the generally triangular shaped boss 81 extending from the first portion 80 of the hinge pin 17 exerts additional retaining force against the inner surface 36 of the first knuckle 18. The retaining means feature of the present invention will become more readily apparent in the following paragraphs describing the operation of the door positioning hinge 10.

As indicated earlier, the door positioning hinge 10 of the present embodiment is mounted to the closure members 150 and 152 by the four screws 104. From that mounted position, two covers 23 can be secured to the hinge assembly, with one cover 23 being mounted with the first hinge leaf 12 and the second cover 23 being mounted with the second hinge leaf 14, as is shown in FIG. 1. In the present embodiment, preferably the covers 23 operate to conceal substantially the entire upper surfaces of the bases 16 and 44 of the first and second hinge leaves 12 and 14, respectively. The attachment of the cover 23 with the respective hinge leaves 12 and 14 is accomplished through the engagement of the tabs 116 with the cavities 32 and 56 of the hinge leaves 12 and 14, respectively. In particular, each of the two covers 23 are secured with the respective hinge leaves by the snap-fit engagement between the tabs 116 and the respective cavities 32 and 56 in the hinge leaves 12 and 14. The snap-fit engagement is facilitated by the flexibility of the tabs 116 which, on initial engagement with the respective hinge leaves 12 and 14, can undergo an amount of flexion and then move back toward its original position when in engagement with the respective cavities 32 and 56, thus providing the snapping action. In the present embodiment, the two covers 23 can be snapped onto the respective hinge leaves 12 and 14 from either the top, such as above the upper surfaces 26 or 50, from the side, such as proximate the outer surfaces 16 or 46, or from any angle between these two directions. For example, the two covers 23 when mounted from directly on top of the upper surfaces 26 or 50 will initially come into engagement with the outer surfaces 22 and 46 of the respective hinge leaves and then, when positioned adjacent the respective cavities 32 and 56, are snapped into the mounted position. The beveled surfaces of the tabs 116 facilitate the mounting of the covers 23; for example, when the door positioning hinge 10 is mounted onto closure members 150 and 152, the closure members can operate to provide a certain amount of interference in some instances. One example of which is when the door positioning hinge 10 is mounted on a carpeted surface, and the carpet pile can, in this situation, operate to interfere with the mounting operation of the respective covers 23. Mounting is accomplished since the beveled surfaces of the tabs 116 will initially engage and then move past the edges of the cavities 32 and 56. When mounted, the tabs 116 provide a secure engagement in order to hold the covers 23 in position on the respective hinge leaves 12 and 14. Thereafter, the covers 23 can be removed by moving the tabs 116 away from the cavities 32 and 56. An example of how this can be accomplished will now be described in relation to the cover 23 mounted on the first hinge leaf 12. Initially, two of the tabs 116 proximate one of the knuckles, for instance the two tabs proximate the knuckle 18, are engaged and then flexed away from the bottom surface 114 of the cover 23. Thereafter, that particular end of the cover 23 can be raised, which is then followed by the two opposite pairs of tabs 116 proximate the knuckle 20 being moved out of the position with the respective cavities 32.

Figure 15:
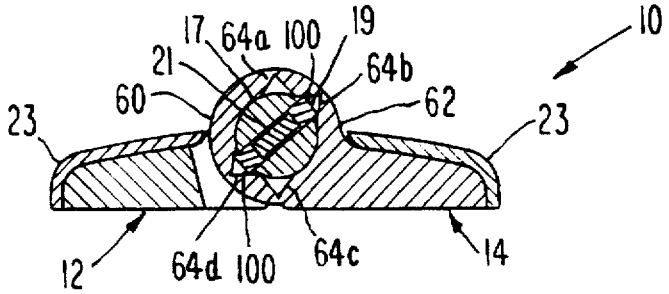
FIG. 15 is a sectional plan view taken along the line 15—15 of FIG. 2*b* and illustrating the door positioning hinge moved into a detent position.

The operation of the door positioning hinge 10 will now be described in reference to the sectional views of FIGS. 15 and 16 taken across the detent knuckle 60 of the second hinge leaf 14. In accordance with the present embodiment, retaining means is provided between the pin assembly 15 and the hinge assembly in order for holding the hinge assembly when the first and second hinge leaves 12 and 14 are rotated to at least one predefined position. For this purpose, the hinge assembly includes at least one detent means for engaging at least one bearing member, which in the present embodiment comprises the two bearing members 100 of the hinge pin insert 19 and the detent means comprises the cavities 64*a–d* within the inner surface 62 of the detent knuckle 60 of the second hinge leaf 14. As is shown in FIG. 15, the bearing members 100 are positioned within the opposing cavities 64*b* and *d*, which defines a detent position for holding the respective closure members 150 and 152 connected with the hinge assembly as shown in FIG. 1. In this embodiment, the cavities 64*b* and *d* are positioned so as to engage the bearing members 100 when the closure members 150 and 152 are in a closed position, with the first and second hinge leaves 12 and 14 being spaced generally 180° apart. The cavities 64*a* and *c* in this embodiment are spaced approximately 50° from the respective cavities 64*b* and *d*, and operates to hold the door when the closure members are rotated the approximately 50° from the closed position toward the open position, at which point the bearing members move into the position within the cavities 64*a* and *c*. As indicated earlier, the number, shape, and angular spacing of the cavities 64 can be varied where desired in order to have the closure members 150 and 152 retained in more or less detent positions and at any desired angular displacement.

Figure 16:
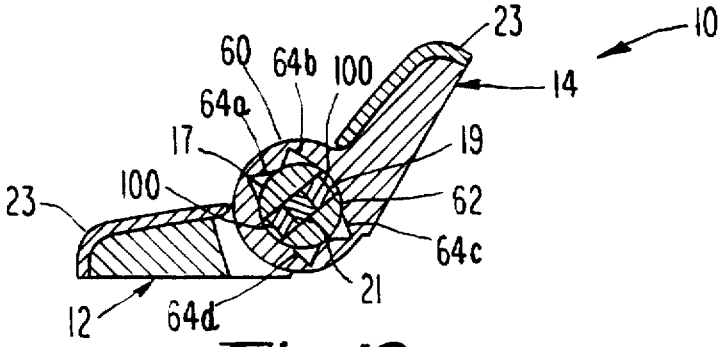
FIG. 16 is a sectional plan view of the door positioning hinge of FIG. 15 and moved out of the detent position.

As is shown in FIG. 16, movement of the hinge assembly between the various detent positions operates to compress the bearing members 100 due to the reduced diameter of the bore of the detent knuckle 60. For example, the bearing members 100 shown in FIG. 16 are slightly compressed and in engagement with the inner surface 62. Thereafter, corresponding rotation of the closure members toward the position of FIG. 15 moves the bearing members 100 against the inner surface 62 and then, when in the position shown in FIG. 15, expand outwardly to engage the cavities 64*b* and *d*. In the present embodiment, the particular V-shaped configuration of the cavities operates to not allow the bearing members 100 to fully extend, but rather the bearing members 100 remain preloaded when positioned within either cavities 64*a,c* or 64*b,d*. The closure members 150 and 152 are thus held in position due to the force exerted by the bearing members 100. A corresponding amount of torque is then required to rotate the closure members in order to move the bearing members 100 out of the respective cavities 64*b,d*. Generally, the amount of torque required to rotate the closure members is dependent on the amount of force which is exerted by the bearing members 100 on the cavities 64*a–d* within the detent knuckle 60.

In accordance with the present embodiment, means for varying the particular amount of force exerted by the bearing members 100, when positioned within the respective cavities, is provided in order to adjust the corresponding amount of torque, which is required for rotation of the hinge assembly and accordingly the closure members from a given detent position. Generally, in the present embodiment there are several ways which this can be accomplished. One way is to change the resiliency of the bearing members 100. For example, in the present embodiment, the bearing members are preferably comprised of plastic, and either the thickness or composition of the plastic can be varied. For instance, as noted earlier, the insert 19 is provided with a generally rectangular cavity 102 between the bearing members 100, which results in each of the bearing members 100 being of a defined diameter between the end of the cavity 102 and the outer surfaces of the bearing members 100. Accordingly, in this embodiment, the size of the cavity 102 can be adjusted to be either larger or smaller in order to vary the resiliency of the bearing members 100 and accordingly the amount of force exerted thereby. In addition, the composition of the bearing members 100 can be changed to comprise materials of more or less resiliency, such as harder or softer plastics. Finally, the amount of force exerted by the bearing members 100 can be varied by the spring 21. In a preferred embodiment, the amount of force exerted by the bearing members 100 is made variable through the elastomer spring 21. In particular, as indicated earlier, this can be accomplished by varying the material of the spring 21, size of the spring 21, shape of the spring 21, or any combination thereof. For example, utilizing a softer elastomer spring of the same size would operate to reduce the amount of force exerted by the bearing members 100. Further, either reducing the size of the spring 21 or in combination with selecting a softer elastomer spring, would also operate to reduce the amount of force exerted by the bearing members 100. In addition, other materials can also be utilized, such as plastic, metal, for example a coil spring, to name a few. In the present embodiment, preferably, the composition of the spring 21 is of a non-corrosive type of material, however, this can be altered where desired. Other combinations are also possible to either increase or decrease the amount of force, and by no way are these examples limiting in any regard.

In accordance with the present embodiment, the amount of force exerted by the bearing members 100 can be varied in the manner set forth above by either removing the pin assembly 15 from an already operational device and then making the desired changes, or, when assembling the door positioning hinge 10, by selecting particular elements corresponding to the desired amount of torque to be provided by the device. For example, with reference to the assembled door positioning hinge 10 shown in FIG. 1, this process can be accomplished by first removing the covers 23, removing the screws 154, removing the pin assembly 15 from within the bores of the two hinge leaves 12 and 14, then making the desired changes, reinserting the pin assembly 15 or another pin assembly, remounting the hinge assembly by the four screws 154, and then reattaching the covers 23. Alternatively, when the door positioning hinge 10 is initially assembled, the particular elements can be chosen depending on the desired resulting amount of force to be provided by the bearing members 100. In a preferred embodiment, the foregoing would be accomplished by simply making changes to or by selecting a particular type of elastomer spring 21, however, any other manner for accomplishing this, such as those set forth above, can also be utilized for the same purpose.

Figure 17:
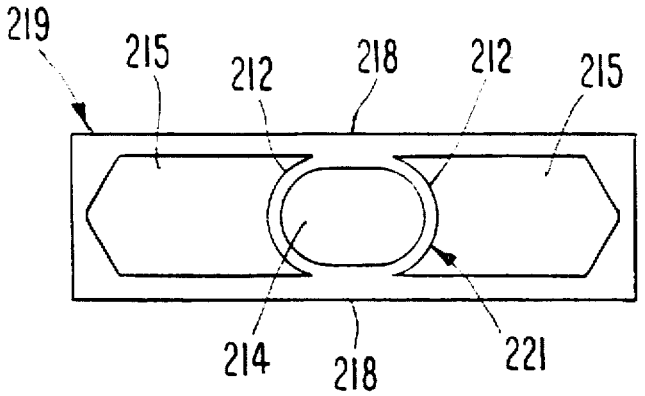
FIG. 17 is a front elevational view of a second embodiment of the hinge pin insert of FIG. 3.
Figure 18:
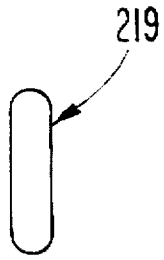
FIG. 18 is a right side elevational view of the hinge pin insert of FIG. 17, the left side being a mirror image.

In FIGS. 17 and 18 are shown another embodiment of a hinge pin insert in accordance with the present invention. In FIG. 17 is shown a front sectional view and in FIG. 18 is a side view of a hinge pin insert 219. The primary difference in the hinge pin insert 219 from the hinge pin insert 19 is that the hinge pin insert 219 includes a spring 221 integrated within its structure rather than having a separate spring, such as the spring 21 shown in FIG. 3. In the present embodiment, the spring 221 comprises a living hinge connected directly with the hinge pin insert 219 providing a one-piece arrangement. As shown in FIG. 17, the living hinge 221 is comprised of two portions 212, each generally semi-circular in cross section. Between each of the two semi-circular portions 212 is a generally circular cavity 214 and two cavities 215 are provided adjacent the sides of the portions 212 opposite the cavity 214. Generally, the cavities 215 are semi-circular at one end adjacent the portions 212, are substantially planar along upper and lower portions, and are tapered inwardly at its end portions opposite the portions 212 of the living hinge 221. In this embodiment, the two bearing members 218 are generally planar, however, as it should be understood, these members can also be substantially concave similar to that shown in relation to the bearing members 100 or alternatively convex. In addition, in this embodiment, the corners do not include a chamfer, however, a chamfer may be included where desired.

The operation of the hinge pin insert 219 in combination with the door positioning hinge 10 will provide a similar function as that of the hinge pin insert 19. In operation, inward force exerted on the bearing members 218 would compress the living hinge 221 resulting with the opposing ends of the semi-circular portions 212 coming closer together. The opposite would be true corresponding with movement of the bearing members 218 from the compressed position to an expanded position. In this embodiment, either the diameter of the portions 212 of the living hinge 221, size or shape of the cavities 214 and 215, can be varied in any manner in order to adjust the amount of force provided by the bearing members 218.

Figure 19:
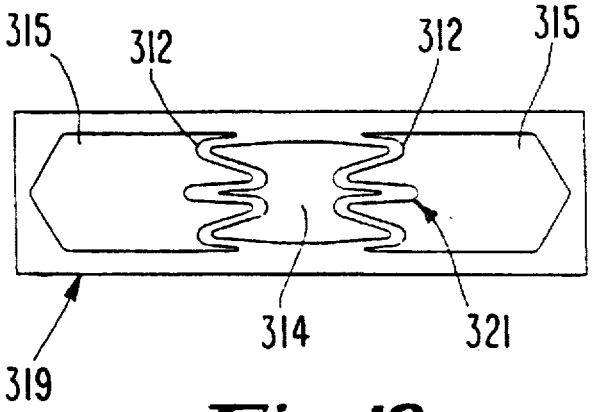
FIG. 19 is a front elevational view of a third embodiment of a hinge pin insert of FIG. 3.
Figure 20:
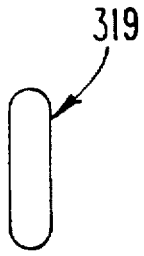
FIG. 20 is a right elevational view of the hinge pin insert of FIG. 19, the left side being a mirror image of that shown.

In FIGS. 19 and 20 are a perspective and side elevational views of another embodiment of an hinge pin insert in accordance with the present invention. In this embodiment, the hinge pin insert 319 is similar to that disclosed above in relation to the hinge pin insert 219. In this embodiment, the difference from the hinge pin insert 219 is that portions 312 of the living hinge 321 are provided of different shape, which is generally sinusoidal in configuration. Furthermore, the configuration of the cavities 314 and 315 are provided corresponding to the configuration of the portions 312 of the living hinge 321. The operation of the hinge pin insert 319 is the same as that set forth above and is not more fully described for this reason.

Figure 21:
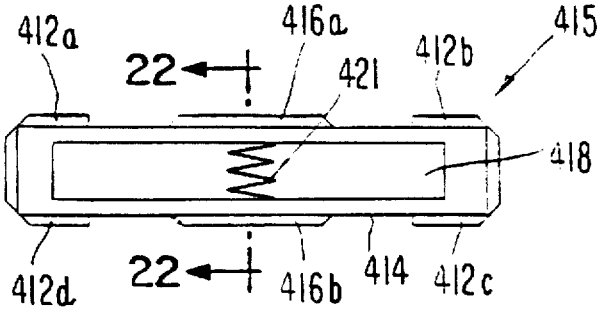
FIG. 21 is a second embodiment of a hinge pin of FIG. 3.
Figure 22:
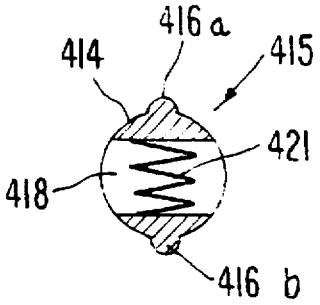
FIG. 22 is a right side elevational view of the hinge pin of FIG. 21, the left side being a mirror image.

In FIGS. 21 and 22 is illustrated another embodiment of a pin assembly in accordance with the present invention. In the present embodiment, the pin assembly 415 comprises an integral hinge pin and hinge pin insert connected as one piece and a spring 421. In the present embodiment, the pin assembly 415 is a substantially elongated member having a generally cylindrical cross section, as is shown in the side view of FIG. 22. Further, in this embodiment, four bosses 412*a–d* are preferably provided connected to an outer pin surface 414 and extending outward therefrom and are positioned proximate opposing ends of the pin assembly 415. In addition, positioned between the bosses 412*a,b* and bosses 412*c,d* are two opposing bosses 416*a,b* which comprise bearing members positioned proximate the central axis of the pin assembly 415 extending between its terminating ends. The pin assembly 415 also includes a cavity 418 disposed therein, which is generally rectangular in this embodiment. Further, positioned within the cavity 418 and between the bearing members 416 is a spring 421, which preferably comprises a metal coil spring, for instance manufactured from either steel or stainless steel. In this embodiment, one end of the coil spring 421 is secured within the cavity 418 proximate the bearing member 416*a*, and the opposite end of the coil spring 421 is secured within the cavity 418 opposite the bearing member 416*b*. For this purpose, any suitable coupling arrangement can be provided for securing the terminating ends of the coil spring, for instance, the pin assembly 415 can be formed with a slight opening within its inner surface provided by the cavity 418 opposite the bearing members 416, into which the terminating ends of the coil spring 421 are inserted. Other than the spring 421, preferably the pin assembly 415 is manufactured of plastic, however, other materials can also be used.

In the operation of the pin assembly 415 in combination with the door positioning hinge 10, the bearing members 416 operate in a similar manner as that of the bearing members 100. Further, the bosses 412 operate in the same manner as that of the portions of the outer surfaces 94 and 96 of the insert 19, which are received within the opposing cavities 42 in the first and second knuckles 18 and 20 for retaining the pin assembly therein. Similarly, with respect to the spring 421, either the size, shape or material can be varied in order to adjust the amount of force exerted by the bearing members 416, similar to that provided by the spring 21 earlier described.

Figure 23:
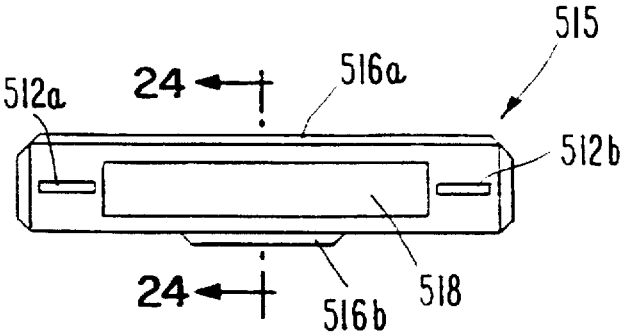
FIG. 23 is a third embodiment of the hinge pin of FIG. 3.
Figure 24:
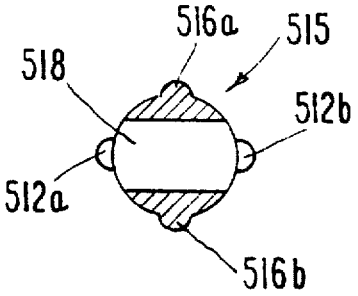
FIG. 24 is a right side elevational view of the hinge pin of FIG. 23, the left side being a mirror image.

In FIGS. 23 and 24 is shown still another embodiment of a pin assembly in accordance with the present invention. In this embodiment, no separate spring is provided and the hinge pin and hinge pin insert are provided as one-piece. In accordance with this embodiment, the function of the spring is provided due to the elastic properties of the pin assembly 515, which is preferably of plastic in this embodiment. As is shown in the front elevational view of FIG. 23, the pin assembly 515 is substantially elongated and is generally cylindrical in cross-section, as is shown in the side view of FIG. 24. Also, two opposing bearing members 516*a* & *b* are provided similar to that shown in connection with the bearing members 416. In this embodiment, preferably four bosses 512*a–d* are provided proximate the opposing ends similar to the bosses 412. The primary difference of the bosses 512*a–d* from the bosses 412*a–d* is that the position of the bosses 512*a–d* are positioned approximately 90° from the position of the bosses 412*a–d*. Specifically, the bosses 412*a–d* are substantially aligned with the bearing members 416*a, b*, as is shown in FIG. 21, and the bosses 512*a–d* are off-set from the position of the bearing members 516*a, b*, which are approximately 90° off-set in this embodiment, as best seen in FIG. 24. As is shown in FIG. 23, a cavity 518 is provided within a central position of the pin assembly 515 and is substantially rectangular in shape, with terminating ends adjacent to the position of the bosses 512*a–d*. As is shown in the side view of FIG. 24, the cavity 518 extending through the pin assembly 515 results with a reduced cross-sectional diameter of the bearing members 516*a, b*.

The operation of the pin assembly 515 in relation to the door positioning hinge 10 is similar to that described above in relation to the pin assembly 415. The primary difference is that the position of the pin assembly 515 is rotated generally 90° in order to be inserted within the bores of the hinge leaf knuckles 18 and 20 due to the off-set position of the bosses 512*a–d*.

Figure 25:
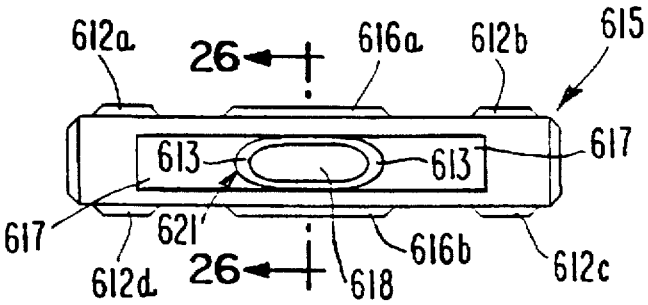
FIG. 25 is a front elevational view of a fourth embodiment of the hinge pin of FIG. 3.
Figure 26:
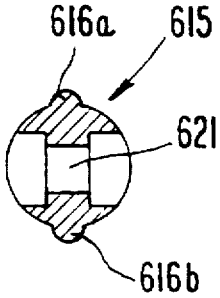
FIG. 26 is a right side elevational view of the hinge pin of FIG. 25, the left side being a mirror image.

In FIGS. 25 and 26 is still another embodiment of a pin assembly in accordance with the present invention. In this embodiment, the pin assembly 615 similar to the pin assembly 515 incorporates a hinge pin and hinge pin insert as one-piece. Also, similar to the hinge pin insert in FIG. 17 the pin assembly 615 also includes a living hinge connected to the pin assembly as one-piece. As shown in the front elevational view of FIG. 25, preferably four bosses 612*a–d* are provided similar to the bosses 412*a–d* shown in FIG. 21. Similarly, bearing members 616*a, b* are provided comprising opposing generally elongated bosses connected with the outer surface of the hinge pin corresponding to the bearing members 416*a, b*. Generally, the internal structure of the pin assembly 615 is similar to that of the pin assembly 215. Specifically, a living hinge 621 comprising two opposing substantially semi-circular portions 613, with a generally circular cavity 618 provided between the two portions. Also, two additional cavities 617 are provided on the opposite side of the two portions 613 of the living hinge 621 similar to the cavities 216. In this embodiment, the pin assembly 615 is also preferably comprised of plastic or other suitable materials. The operation of the pin assembly 615 is similar to that described above in relation to the pin assembly 415, and will not be further described for this reason.

Figure 27:
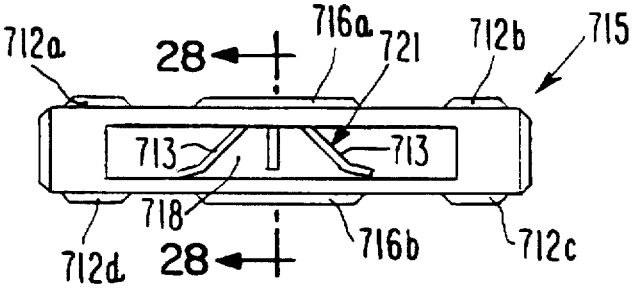
FIG. 27 is a front elevational view of a fifth embodiment of the hinge pin of FIG. 3.
Figure 28:
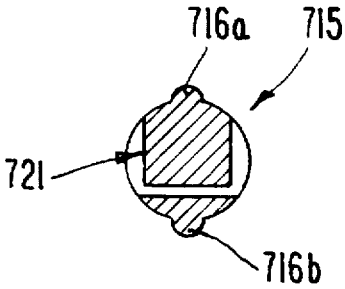
FIG. 28 is a right side elevational view of the hinge pin of FIG. 27, the left side being a mirror image of that shown.

In FIGS. 27 and 28 is shown still another embodiment of a pin assembly in accordance with the present invention. In this embodiment, the pin assembly 715 is shown which is similar to the pin assembly 615 described above. In particular, the pin assembly 715 incorporates an integral one-piece living hinge 721 which is comprised of two portions 713. In this embodiment, the living hinge 721 is provided by having each of the portions 713 formed to and extending outward from the inner cavity surface opposite the bearing member 716*a*, and which extend in the direction of and engage the opposing inner cavity surface opposite the bearing member 716*b*. In this manner, the biasing force is provided through the interaction between the terminating ends of the two portions 713 of the living hinge 721 with the inner cavity surface of the cavity 718 proximate the bearing member 716*b*. The remaining structure and operation of the pin assembly 715 is the same as the pin assembly 615.

Figure 29:
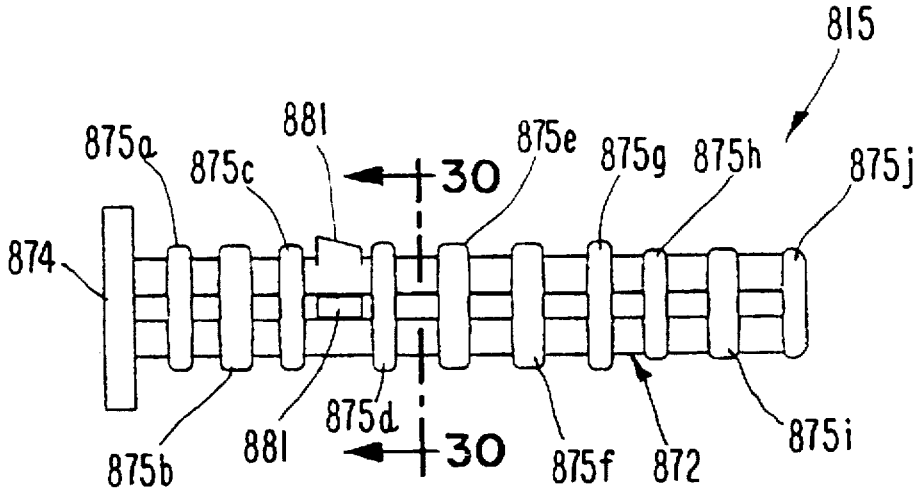
FIG. 29 is a front elevational view of a sixth embodiment of the hinge pin of FIG. 3.
Figure 30:
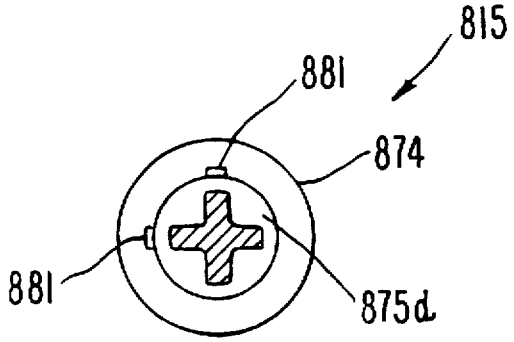
FIG. 30 is a sectional right side elevational view, taken along the line 30—30 of FIG. 29.

In FIG. 29 is shown a front elevational view of another pin assembly in accordance with the present invention. The pin assembly 815 in this embodiment differs from the earlier pin assembly 15 in that there is no portion operating as a bearing member. The pin assembly 815 comprises in the present embodiment a substantially elongated portion 872 and a disc shaped top 874 connected to one end of the portion 872 and which is substantially circular in configuration. In a preferred embodiment, the portion 872 is provided with a series of substantially angular bosses extending from its outer surface, and in the present embodiment, 10 bosses 875*a–j* are provided as is shown in FIG. 29. Preferably, the diameter of each of the bosses 875*a–j* are sized corresponding to the diameter of the bores through the knuckles into which the bosses 875*a–j* are received. For example, with reference to the knuckles 12 and 14 shown in FIG. 3, the bosses 875*a–g* are of substantially the same diameter and sized in order to be received within the bores through the first knuckle 18 and detent knuckle 60, and the bosses 875*h–j* are of a slightly smaller diameter than the bosses 875*a–g* in order to be received within the second knuckle 20, which is of a correspondingly smaller diameter in the present embodiment. The bosses 875*a–j* may be separate elements inserted onto the portion 872 or, alternatively, may be formed integral with the portion 872 as is shown in the present embodiment. In the present embodiment, two triangular shaped bosses 881 are also provided that are similar in configuration to one another and extend outward from the outer surface of the portion 872, and which are similar to the triangular shaped boss 881 in FIG. 3. In FIG. 30 is shown the relationship between the bosses 881, boss 875*d* and disc 874, which is taken along the line 30—30 of FIG. 29. In the present embodiment, the diameter of the disc 874 is larger than that of the bosses 881, and the bosses 881, in turn, are larger in diameter than that of the boss 875*d*. In addition, as best seen in FIG. 30, in the present embodiment the cross-section of the portion 872 between each of the bosses 875*a–j* is substantially in the shape of a cross or "plus" sign.

Generally, the pin assembly 815 is utilized where it is desired that the hinge be free-swinging in operation. In operation in connection with the door positioning hinge 10, the pin assembly 815 is inserted in the same manner through the bores of the knuckles provided in the two hinge leaves 12 and 14. Since there are no bearing members in the pin assembly 815, there is nothing to come into engagement with the cavities 64A*–d* of the detent knuckle 60. Accordingly, in operation the first hinge leaf 12 is freely rotatable relative to the second hinge leaf 14, thus providing the same corresponding operation of the closure members 150 and 152.

In view of the foregoing description, it should be understood that there are several advantages of the present invention. In particular, one advantage is that the present invention provides a door positioning hinge which is versatile and can be used for a number of different applications. For instance, the door positioning hinge of the present invention can be utilized as a free-swinging hinge by incorporating the pin assembly 815. In addition, the door positioning hinge of the present invention can be utilized as a detent hinge which operates to hold the closure members in any number of predefined detent positions. The detent operation of the door positioning hinge of the present invention is accomplished by incorporating various pin assemblies which provide retaining means between the pin assembly and the hinge assembly. Various pin assembly arrangements are disclosed in FIGS. 1–27 which are desirable for this purpose, for example, various single piece and multiple piece arrangements are shown.

Another advantage of the door positioning hinge of the present invention which contributes to its versatility is that means are provided for adjusting the amount of force exerted by the pin assembly which operates to hold the hinge in the detent positions. In the present invention, this can be accomplished in a number of different ways, for example, by selecting different materials, sizes and/or shapes of the various components comprising the pin assembly.

Another feature attributing to the versatility of the door positioning hinge of the present invention is that the device can be comprised of non-corrosive materials, which ensures continued proper operation of the hinge, which is in contrast to prior art devices which undergo corrosion over time and which can occur from moisture or other environmental conditions.

Still another advantage of the present invention is that the device can be easily and quickly assembled together. For example, the pin assembly is inserted into the bores in the knuckles of the hinge leaves in order to join together the hinge assembly and then the two covers are mounted over the hinge leaves after the door positioning hinge has been mounted to the respective closure members. Another advantage here is that attachment means are provided between the covers and the hinge leaves which enables the covers to be easily snap-fit with the hinge leaves and also allows the covers to be mounted from a number of different directions relative to each respective hinge leaf. The mounting of the covers operates to both conceal the mounting screws which are utilized in the present embodiment and also provide a slight deterrent against hinge removal since the screws are covered from view. Also, the covers can be easily removed from the hinge means which allows quick disassembly of the hinge for any desired repair or change of components corresponding with altering the amount of retaining force exerted by the hinge.

Still another advantage is that the mechanism by which the detent feature is accomplished is all provided as a part of the pin assembly, which allows for a smaller hinge construction. Specifically, in U.S. Pat. No. 5,412,842, there is additional space required within the hinge leaves in order to accommodate coil springs and detent balls which increases the required size of the hinge. In addition, the pin assembly not only incorporates the mechanism providing the detent feature of the present door positioning hinge, but also the pin assembly incorporates retaining means which, together with the first hinge leaf, operates to retain the position of the pin assembly within the first hinge leaf.

It will be recognized by those skilled in the art that changes may be made by the above-described embodiments of the invention without departing from the broad inventive concepts thereof. For example, other embodiments of the present invention can incorporate only one or any number of the features which are disclosed in connection with the door positioning hinge 10. In addition, the position of the detent means and bearing member(s) may be switched in that the detent means provided as a part of the pin assembly and the bearing member(s) provided as a part of the detent knuckle of the second hinge leaf. Further, the position of the retaining means between the pin assembly and the knuckles of the first hinge leaf may be switched in that the boss(es) provided as a part of the knuckles of the first hinge leaf and the cavity or cavities provided as a part of the pin assembly. Also, the retaining means may be provided within only one of the two knuckles of the first hinge leaf. The retaining means may also be provided within the detent knuckle in the second hinge leaf in addition to being present in one or both of the knuckles of the first hinge leaf or, alternatively, may be provided in the detent knuckle instead of in the knuckles of the first hinge leaf. In addition, the position of the bearing member(s) and detent means may be switched from the detent knuckle to enter one or both of the knuckles of the first hinge leaf, or may be provided in one or both of the knuckles of the first hinge leaf in addition to being present in the detent knuckle of the second hinge leaf. The number of knuckles of the first and second hinge leaves may also be varied to be more or less, where desired. The positions of the first and second hinge leaves on the respective closure members may also be exchanged. It is understood, therefore, that this invention is not limited to the particular embodiments disclosed, but it is intended to cover all modifications which are within the scope and spirit of the invention as defined by the appended claims.

We claim:

1. A door positioning hinge comprising:

a hinge assembly including a first hinge means and a second hinge means, each of the first and second hinge means having at least one bore;

a pin assembly disposed within the bores of the first and second hinge means connecting the hinge assembly for rotatable movement of said first hinge means relative to said second hinge means, said pin assembly including a generally elongated hinge pin having a central axis extending in a longitudinal direction thereof and at least one generally biased bearing member, wherein said hinge pin includes at least one cavity therein positioned adjacent said at least one generally biased bearing member, wherein said at least one hinge pin cavity defines a reduced cross-sectional diameter of said at least one generally biased bearing member;

said hinge assembly further including detent means for engaging said at least one generally biased bearing member when said first and second hinge means are rotated to at least one predefined position.

2. A door positioning hinge of claim 1, wherein said hinge pin includes an outer pin surface terminating at a predetermining distance from said central axis, said pin assembly further including at least one boss proximate said outer pin surface, said at least one boss having an outer boss surface terminating a predetermined distance from said central axis of said hinge pin, wherein said predetermined distance of said outer pin surface at least at least one proximate said at least one boss is less than said predetermined distance of said outer boss surface of said at least one boss, whereby at least a section of said boss comprises said at least one generally biased bearing member.

3. A door positioning hinge of claim 2, wherein said pin assembly includes two bosses substantially aligned with each other, with at least a section of each of said bosses defining in combination two bearing members.

4. A door positioning hinge of claims 2 or 3, wherein said bosses and said hinge pin are of one-piece, with said bosses connected with said outer pin surface.

5. A door positioning hinge of claim 2, wherein said hinge pin further includes an insert cavity within said outer pin surface and an insert, said insert including a first portion received within said insert cavity and at least a second portion outside of said insert cavity comprising said at least one boss.

6. A door positioning hinge of claim 5, wherein said insert cavity extends through said hinge pin and said insert includes at least a third portion outside of said cavity and comprising a second boss.

7. A door positioning hinge of claim 6, wherein said insert cavity is substantially rectangular in cross-section.

8. A door positioning hinge of claim 6, wherein said insert defines a pair of opposing end surfaces and a pair of outer surfaces connected with said end surfaces, said outer surfaces defining said at least one boss and said second boss and at least a section of each of said outer surfaces defining in combination two bearing members, said two bearing members being substantially aligned with each other and said insert between at least two said bearing members defining an insert diameter, said hinge pin at least proximate said cavity there-through defining a hinge pin diameter, wherein said insert diameter is larger than said hinge pin diameter.

9. A door positioning hinge of claims 3 or 8, wherein said bearing members are positioned proximate a central axis of said hinge pin between opposing ends thereof.

10. A door positioning hinge of claim 9, wherein each of said bearing members include an outer surface for engaging said detent means, wherein said outer surface is substantially planar.

11. A door positioning hinge of claim 9, wherein each of said bearing members include an outer surface for engaging said detent means, wherein said outer surface is substantially radiused.

12. A door positioning hinge of claims 3 or 8, wherein said bearing members are substantially elastic.

13. A door positioning hinge of claim 12, wherein said at least one hinge pin cavity is within said insert.

14. A door positioning hinge of claim 12, further including a spring within said at least one hinge pin cavity.

15. A door positioning hinge of claim 14, wherein said spring comprises a coil spring.

16. A detent hinge of claim 14, wherein said spring is elastomeric.

17. A door positioning hinge of claim 16, wherein said elastomeric spring is substantially rectangular.

18. A door positioning hinge of claim 14, wherein said spring comprises a living hinge formed as part of said insert.

19. A door positioning hinge of claim 2, further including means between said pin assembly and said first hinge means for retaining said pin assembly.

20. A door positioning hinge of claim 19, wherein said pin assembly includes at least a second boss and said first hinge means includes means within said bore thereof for receiving said second boss comprising said retaining means.

21. A door positioning hinge of claim 20, wherein said second boss is connected with said one boss.

22. A door positioning hinge of claim 1, wherein said hinge assembly further includes at least one cover and attachment means between said at least one cover and at least one of said first and second hinge means for snap-fitting together said at least one cover and said at least one of said first and second hinge means.

23. A door positioning hinge of claim 22, wherein said at least one cover includes at least one tab and said at least one of said first and second hinge means includes at least one pocket into which said at least one tab is received.

24. A door positioning hinge of claim 23, wherein said first and second hinge means each comprises a hinge leaf having a base, said base having an upper and a lower surface, and at least one knuckle extending from said base, said hinge further including two covers, with each cover having an upper surface, a bottom surface and at least one tab, and each of said first and second hinge means having at least one pocket, wherein each cover is snap-fit with one of said hinge means through engagement of said at least one tab and said at least one pocket to conceal substantially the entire upper surface of said base of said first and second hinge means.

25. A door positioning hinge of 24, wherein said at least one tab of each cover is positioned on the bottom surface thereof and concealed by the upper surface thereof when connected with said hinge means, wherein said at least one pocket of each hinge means is positioned substantially within the bottom surface thereof and corresponding to a position of said at least one tab.

26. A door positioning hinge of 25, wherein each of said covers includes a substantially U-shaped outer surface, a substantially planar inner surface connected with said outer surface and four tabs, with a first pair of said tabs being positioned within said outer surface proximate opposite ends thereof and a second pair of said tabs being positioned within said outer surface and between said first pair of tabs, wherein said base of each of said first and second hinge means includes four pockets positioned corresponding to said positions of said four tabs for accommodating the snap-fit engagement thereof.

27. A door positioning hinge of 26, wherein each tab includes a substantially beveled surface at its terminating end distal its connection with said bottom surface of said cover.

28. A door positioning hinge of claim 1, wherein said second hinge means includes said detent means within said bore thereof.

29. A door positioning hinge of claim 28, wherein said bore of said second hinge means defines an inner surface, wherein said inner surface of said bore of said second hinge means includes at least one cavity therein adapted for receiving said bearing member comprising said detent means.

30. A door positioning hinge comprising:

a hinge assembly including a first hinge means and a second hinge means, each of the first and second hinge means having at least one bore, wherein said first hinge means comprises a hinge leaf having first and second knuckles at spaced separation, each of said first and second knuckles having a single bore defining an inner surface, wherein each of said knuckles includes at least one pair of substantially opposing cavities within said inner surface of each said single bore;

a pin assembly disposed within the bores of the first and second hinge means connecting the hinge assembly for rotatable movement of said first hinge means relative to said second hinge means, said pin assembly including at least one generally biased bearing member, wherein said pin assembly comprises a generally elongated hinge pin having a central axis extending in a longitudinal direction thereof, said hinge pin including an outer pin surface terminating at a predetermining distance from said central axis, said pin assembly further including at least four bosses proximate said outer pin surface, each of said at least four bosses having an outer boss surface terminating a predetermined distance from said central axis of said hinge pin, wherein said predetermined distance of said outer pin surface at least proximate each of said at least four bosses is less than said predetermined distance of said outer boss surface of said at least four bosses, whereby at least a section of each of said at least four bosses comprises said bearing member, wherein a portion of each of said at least four bosses is positioned for being received within said opposing cavities of said first and second knuckles;

said hinge assembly further including detent means within at least one of said first hinge means or said second hinge means for engaging said at least one generally biased bearing member when said first and second hinge means are rotated to at least one predefined position.

31. A door positioning hinge of claim 30, wherein said four bosses and said pin assembly are of one-piece, with said bosses being connected to said outer surface of said hinge pin.

32. A door positioning hinge of claim 30, wherein said hinge pin includes a cavity extending therethrough and an insert, said insert defining a pair of end surfaces and a pair of outer surfaces connected with said end surfaces, wherein said four bosses are defined by two upper bosses and two lower bosses, with said two upper bosses being connected together and said two lower bosses being connected together comprising said outer surfaces of said insert.

33. A door positioning hinge of claim 30, wherein a cross-section of said cavities correspond substantially to a cross-section of said bosses.

34. A door positioning hinge comprising:

a hinge assembly including a first hinge means and a second hinge means, each of the first and second hinge means having at least one bore;

a pin assembly disposed within the bores of the first and second hinge means connecting the hinge assembly for rotatable movement of said first hinge means relative to said second hinge means, said pin assembly including at least one generally biased bearing member;

said hinge assembly further including detent means within at least one of said first hinge means or said second hinge means for engaging said at least one generally biased bearing member when said first and second hinge means are rotated to at least one predefined position, wherein said second hinge means defines a hinge leaf having a detent knuckle, said detent knuckle having a bore therethrough defining an inner surface, wherein said detent knuckle includes at least one pair of substantially opposing cavities within said inner surface of said bore and said pin assembly includes at least two bearing members positioned for being received within said opposing cavities of said detent knuckle comprising said detent means.

35. A door positioning hinge of claim 34, wherein said detent knuckle includes at least two pairs of substantially opposing cavities within said inner surface of said bore, said first pair of said cavities being positioned for receiving said bearing members when said hinge is in a closed position and said second pair of said cavities being positioned for receiving said bearing members when said hinge is in an open position.

36. A door positioning hinge of claim 34, wherein said cavity of said bore is substantially V-shaped in configuration.

37. A door positioning hinge comprising:

a hinge assembly including a first hinge means and a second hinge means, each of the first and second hinge means having at least one bore;

a pin assembly disposed within the bores of the first and second hinge means connecting the hinge assembly for rotatable movement of said first hinge means relative to said second hinge means, said pin assembly including at least one generally biased bearing member;

said hinge assembly further including detent means for engaging said at least one generally biased bearing member when said first and second hinge means are rotated to at least one predefined position, wherein said at least one generally biased bearing member exerts a defined amount of force upon said detent means for holding said predefined position of said first and second hinge means, wherein a corresponding amount of torque is required for rotation of said first and second hinge means from said predefined position, said hinge assembly further including means for varying the defined amount of force exerted by said bearing member upon said detent means for adjusting the corresponding amount of torque required for rotation of said first and second hinge means from said predefined position, wherein said pin assembly further includes a spring for biasing said at least one generally biased bearing member comprising said varying means.

38. A door positioning hinge of claim 37, wherein said spring is elastomeric and of a defined size and resiliency, and said defined amount of force is variable through selecting at least one of said defined size or resiliency of said elastomeric spring.

39. A door positioning hinge of claim 37, wherein said pin assembly comprises a generally elongated hinge pin having an outer pin surface, with said at least one generally biased bearing member positioned proximate said outer pin surface, said hinge pin including a cavity therein positioned adjacent said at least one generally biased bearing member, with said elastomer spring received within said cavity.

40. A door positioning hinge of claim 39, wherein said bearing member comprises at least two bosses connected as one-piece with said outer pin surface and substantially aligned with each other, wherein said cavity is positioned between said bosses.

41. A door positioning hinge of claim 39, wherein said hinge pin includes an opening within said outer pin surface and extending therethrough and an insert received within said opening, said insert defining a pair of opposing end surfaces and a pair of outer surfaces connected with said end surfaces, at least a portion of each of said outer surfaces comprising a bearing member, wherein said cavity is positioned within said insert and between said bearing members.

42. A door positioning hinge at claims 40 or 41, wherein said first hinge means comprises a hinge leaf having first and second knuckles at spaced separation, each of said knuckles having a bore and said second hinge means comprises a hinge leaf having a detent knuckle positioned between said knuckles of said first hinge leaf, said detent knuckle having a bore therethrough defining an inner surface and at least one pair of opposing cavities within said inner surface as said detent means.

43. A door positioning hinge of claim 37, further including at least a second pin assembly for replacing said pin assembly, wherein said at least a second pin assembly is disposed within the bores of the first and second hinge means for free-swinging operation, whereby said first hinge means is freely rotatable relative to said second hinge means.

44. A door positioning hinge comprising:

a hinge assembly including a first hinge means and a second hinge means, each of the first and second hinge means having at least one bore;

a pin assembly disposed within the bores of the first and second hinge means connecting the hinge assembly for rotatable movement of said first hinge means relative to said second hinge means; and at least one cover and attachment means between said at least one cover and at least one of said first and second hinge means for snap-fitting together said at least one cover and said at least one of said first and second hinge means, wherein said attachment means includes at least one substantially flexible tab attached to at least one of said cover or said first and second hinge means, whereby on initial engagement of said cover with said at least one of said first and second hinge means, said substantially flexible tab undergoes an amount of flexion from an original position to a flexed position, with said substantially flexible tab then moving back toward said original position when said cover and said at least one of said first and second hinge means are snap-fit together.

45. A door positioning hinge of claim 44, wherein said at least one cover includes said at least one tab and said at least one of said first and second hinge means includes at least one pocket into which said at least one tab is received.

46. A door positioning hinge of claim 45, wherein said first and second hinge means each comprises a hinge leaf having a base, said base having an upper and a lower surface, and at least one knuckle extending from said base, said hinge further including two covers, with each cover having an upper surface, a bottom surface and at least one tab, and each of said first and second hinge means having at least one pocket, wherein each cover is snap-fit with one of said hinge means through engagement of said at least one tab and said at least one pocket to conceal substantially the entire upper surface of said base of said first and second hinge means.

47. A door positioning hinge of 46, wherein said at least one tab of each cover is positioned on the bottom surface thereof and concealed by the upper surface thereof when connected with said hinge means, wherein said at least one pocket of each hinge means is positioned substantially within the bottom surface thereof and corresponding to a position of said at least one tab.

48. A door positioning hinge of 47, wherein each of said covers includes a substantially U-shaped outer surface, a substantially planar inner surface connected with said outer surface and four tabs, with a first pair of said tabs being positioned within said outer surface proximate opposite ends thereof and a second pair of said tabs being positioned within said outer surface and between said first pair of tabs, wherein said base of each of said first and second hinge means includes four pockets positioned corresponding to said positions of said four tabs for accommodating the snap-fit engagement thereof.

49. A door positioning hinge of 48, wherein each tab includes a substantially beveled surface at its terminating end distal its connection with said bottom surface of said cover.

* * * * *